US010519616B2

(12) United States Patent
Casadio et al.

(10) Patent No.: US 10,519,616 B2
(45) **Date of Patent: *Dec. 31, 2019**

(54) FLOATING DEBRIS SKIMMING DEVICE

(71) Applicant: SkimKing, Inc., Sarasota, FL (US)

(72) Inventors: Nicolas Casadio, Sarasota, FL (US); Christian Casadio, Sarasota, FL (US); Guy Raz, Austin, TX (US); Moshe Zruya, Austin, TX (US)

(73) Assignee: SKIMKING, INC., Sarasota, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/960,702

(22) Filed: Apr. 24, 2018

(65) Prior Publication Data

US 2018/0238009 A1 Aug. 23, 2018

Related U.S. Application Data

(63) Continuation of application No. 15/240,364, filed on Aug. 18, 2016, now Pat. No. 9,976,271.

(60) Provisional application No. 62/206,565, filed on Aug. 18, 2015.

(51) Int. Cl.

| | |
|---|---|
| ***E02B 15/04*** | (2006.01) |
| ***E04H 4/16*** | (2006.01) |
| ***E02B 15/10*** | (2006.01) |
| ***E04H 4/12*** | (2006.01) |

(52) U.S. Cl.
CPC ..... *E02B 15/104* (2013.01); *E04H 4/1263* (2013.01); *E04H 4/1654* (2013.01)

(58) Field of Classification Search
CPC ..... E02B 15/048; E02B 15/10; E02B 15/104; E04H 4/1263; E04H 4/1654
USPC ..... 210/167.2, 170.05, 242.1, 747.6, 776; 4/490, 496
See application file for complete search history.

(56) References Cited

U.S. PATENT DOCUMENTS

| | | | |
|---|---|---|---|
| 4,900,432 | A | 2/1990 | Arnold et al. |
| 5,001,800 | A | 3/1991 | Parenti et al. |
| 5,106,492 | A | 4/1992 | Distinti et al. |
| 7,101,475 | B1 | 9/2006 | Maaske et al. |
| 7,485,235 | B2 | 2/2009 | Kellett |
| 8,341,789 | B2 | 1/2013 | Garti |
| 9,527,537 | B2 | 12/2016 | Bernini |
| 9,976,271 | B2 * | 5/2018 | Casadio ..... E02B 15/104 |
| 2012/0055856 | A1 | 3/2012 | Ratti et al. |
| 2014/0197088 | A1 | 7/2014 | Greve et al. |
| 2017/0051467 | A1 | 2/2017 | Casadio et al. |

FOREIGN PATENT DOCUMENTS

| | | |
|---|---|---|
| DE | 19951436 C2 | 3/2001 |

* cited by examiner

*Primary Examiner* — Christopher Upton
(74) *Attorney, Agent, or Firm* — Shumaker, Loop & Kendrick, LLP

(57) ABSTRACT

A skimming device configured to collect and store floating debris captured from a body of water. The debris includes at least one of liquid debris such as petrochemicals, semi-solid debris, and/or solid debris on or near the surface of the body of water.

12 Claims, 4 Drawing Sheets

FLOATING DEBRIS SKIMMING DEVICE

CROSS-REFERENCE TO RELATED APPLICATIONS

This U.S. Non-Provisional Patent Application is a continuation claiming priority from pending U.S. Non-Provisional patent application Ser. No. 15/240,364 filed on Aug. 18, 2016, which claims priority from U.S. Provisional Patent Application No. 62/206,565 filed on Aug. 18, 2015, which are incorporated by reference herein in its entirety.

TECHNICAL FIELD

The present invention generally relates to the field of debris skimming devices, and more particularly, to skimming devices for removing floating debris (liquid, solid, and/or semi-solid debris) on or near the water surface in swimming pools, ponds, lakes, bays, and other large marine environment(s).

BACKGROUND

In bodies of water (e.g., swimming pools, ponds, lakes, bays, and larger marine environment(s)) floating debris such as leaves, tree limbs, litter, petrochemicals, and other liquid and semi-solid debris are a frequent nuisance. These floating debris affect the aesthetic appearance of the body of water while concurrently creating safety concerns/hazards such as affecting water quality. For example, in lakes, ponds, bays, and larger marine environments, floating debris frequently damages watercrafts and may further create dangers for swimmers. Few, if any, debris collecting and/or debris skimming devices exist that clean lakes, ponds, bays, and other large marine environments. Thus, the above mentioned problems persist in these bodies of water.

Likewise, floating debris is also a major nuisance in swimming pools. This debris may compromise the physical safety of swimmers while further affecting optimal pool water conditions (e.g., affecting alkalinity, acidity, etc.). Thus, pool cleaning and skimming are necessary for health, safety, and aesthetic reasons to maintain proper conditions for swimming pool use. Conventional pool cleaning and skimming devices are routinely used to filter debris and other objects from swimming pools in order to maintain pool appearance and facilitate the use thereof, but most current pool cleaning devices only remove debris from the pool bottom. These devices are very expensive, require complex assembly, are tethered to external power sources and/or compressed air supplies, and are cumbersome to operate. To remove surface/floating debris from a pool, hand-held, pole-mounted skimming nets and rakes are currently used. Similar to the above mentioned pool cleaning devices, these skimming nets and rakes are also cumbersome and require strenuous physical labor to remove floating debris from the pool surface. Thus, the current devices and methods used for pool skimming are undesirable for at least the above mentioned reasons.

BRIEF SUMMARY

In view of the above mentioned problems, a need exists to provide a floating debris skimming device that is easily assembled/disassembled, easy to operate, and relatively inexpensive to manufacture and/or maintain. Preferably, the disclosed floating debris skimming devices can be used to clean numerous different bodies of water, including but not limited to, swimming pools, ponds, lakes, bays, and other large marine environment(s). It is envisioned that the device's overall size may vary depending on the desired application, but the overall arrangement of structural features preferably remains the same regardless of size variation. For example, in certain aspects, devices configured for skimming floating debris from ponds, lakes, and/or bays may be considerably larger and have more debris collecting capacity than, for example, a device configured to skim floating debris from swimming pools. In certain aspects, the skimming device not only operates in the water but is also an amphibious device capable of moving both in water bodies and on land, as desired by the user.

Disclosed is a skimming device configured to collect and store floating debris captured from the surface of a body of water (e.g., swimming pools, ponds, lakes, bays, and larger marine environment(s)). The skimming device includes a debris collector having an enclosed body defining an opening for receiving and storing captured debris therein; a skimming device movement member positioned on opposite sides of the debris collector, the skimming device movement member comprising two parallel spaced apart endless belts that are each configured to independently move the skimming device in the body of water; a debris movement member positioned between and extending away from each endless belt, the debris movement member being aligned with the opening of the debris collector and configured to capture floating debris from the body of water and pass the captured debris into the debris collector by moving the debris movement member and the captured debris thereon in a direction towards the debris collector, and a housing that surrounds the debris collector and skimming movement member such that the two endless belts of the skimming movement member extend above and below the housing.

In certain aspects, the debris movement member is a conveyor belt having a first end surrounded by the housing and a second end that extends away from and is outside of the housing.

In certain aspects, a recess is formed on the housing and is aligned with the opening of the debris collector to provide clearance allowing the captured debris to be passed from the conveyor belt into the debris collector.

In certain aspects, the second end of the conveyor belt is angled relative the two endless belts and is configured to extend into the body of water.

In certain aspects, only the first end of the conveyor belt and portions of the two endless belts extending below the housing are configured to extend into the body of water.

In certain aspects, the debris collector is removable/detachable from the skimming device thereby allowing the debris collector to be emptied as desired by the user.

In certain aspects, the skimming device further includes a first set of deployable arms connected to the housing that are configured to direct floating debris towards the conveyor belt. Each arm may be angled relative to each other (e.g., convergent angles) to create a funnel-like structure that directs floating debris onto the debris movement member/conveyor belt when debris contacts any arm of the first set of deployable arms.

In certain aspects, the skimming device further includes a second set of deployable arms connected to the housing on a side of the housing opposite the first set of deployable arms. Alternatively and instead of a second set of deployable arms, the skimming device can include one or more non-motorized wheel(s) connected to the housing on a side of the housing opposite the first set of deployable arms. For example, the skimming device may include two spaced apart wheels connected to the housing on a side opposite the first set of deployable arms. The non-motorized wheel(s) rotate and/or turn freely thereby acting as bumpers when the non-motorized wheel(s) contacts an object.

In certain aspects, portions of the debris collector, two endless belts, the first set of deployable arms, and the second set of deployable arms are coplanar relative to each other while the second end of the conveyor belt is not coplanar with the two endless belts and debris collector.

In certain aspects, the skimming device is battery operated, configured for remote control, or a combination thereof.

In certain aspects, the skimming device is configured for Wi-Fi connectivity, remote control from a peripheral device, to be guided by a global positioning system (GPS) or other remote methods, or a combination thereof. In certain aspects, the skimming device may be configured for data collection via onboard sensors housed within the device that are able to communicated with a user's peripheral device.

In certain aspects, the debris collector and housing comprise a molded thermoplastic resin, a metal or metal alloy, or a combination thereof.

In certain aspects, the enclosed body of the debris collector includes a transparent upper panel on an upper portion of the debris collector for viewing collected/captured debris inside the collector to further aid in determining when to empty the collected/captured debris from the debris collector.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION

These and other features, aspects and advantages of the present invention are better understood when the following detailed description of the invention is read with reference to the accompanying drawings, in which.

DETAILED DESCRIPTION

Figure 1:
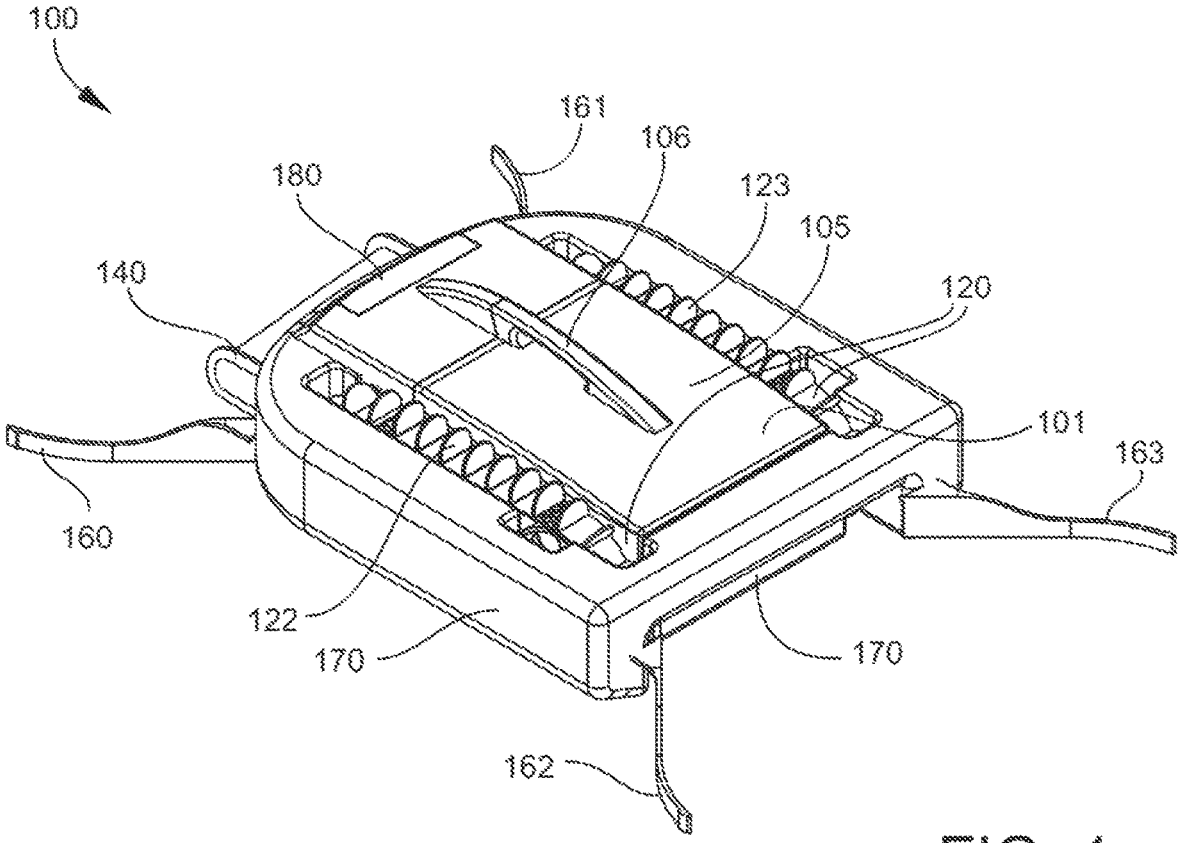
FIG. 1 is a top perspective view of the skimming device.

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Disclosed is a skimming device 100 that collects and stores floating debris captured from the surface of a body of water. Skimming device 100 has a wide variety of uses and applications including skimming the surface/cleaning the surfaces of various bodies of water, including but not limited to, swimming pools, ponds, lakes, bays, and larger marine environment(s) thereby maintaining the water surface's aesthetic appearance while concurrently reducing safety hazards and potentially improving water conditions (e.g., pH, etc.). The size of the skimming device 100 may be varied accordingly in order to skim/clean the water surface of swimming pools, ponds, lakes, bays, and larger marine environment(s). In certain aspects, the skimming device is an amphibious device capable of moving both in water bodies and on land.

In certain aspects, the skimming device 100 remains buoyant at all times while in the water with only a few portions of the device (e.g., portions of the debris movement member and portions of skimming device movement member) ever being submerged beneath the water's surface while the skimming device is in operation. As shown in FIGS. 1-7, the skimming device 100 includes at least a debris collector 101, a skimming device movement member 120, and a debris movement member 140 that are each at least partially housed/positioned within housing 170. As disclosed in further detail below, the skimming device includes a debris collector 101 configured for receiving and storing captured debris therein; a skimming device movement member 120 configured to move the skimming device in the body of water; a debris movement member 140 configured to capture floating debris (e.g., liquid debris such as floating petrochemicals, semi-solid debris, and/or solid debris) from the body of water and pass the captured debris into the debris collector 101; and a housing 170 that surrounds the debris collector 101 and skimming movement member 120 such that the two endless belts 122, 123 of the skimming movement member extend above and below the housing.

In particular, the debris collector 101 includes an enclosed body 102 defining an opening 103 for receiving and storing the collected debris. In certain aspects, the debris collector 101 may further include an arcuate front wall 104 adjacent to opening 103 that traps debris within the debris collector 101. The debris collector 101 is removably received in housing 170 between the endless belts 122, 123 of the skimming device movement member 120. When the skimming device 100 is in operation, the debris collector 101 is secured to the housing 170 using a desired fastening engagement including, for example, using, complimentary snap fit engagements, sliding engagements, or a combination thereof between the debris collector 101 and the housing 170. The debris collector 101 can be modified in size accordingly, but the debris collector is preferably large enough to collect, for example, leaves, twigs, tree limbs, bottles, and soft drink containers (e.g., 12 oz. cans, 16 oz. plastic bottles, 20 oz. plastic bottles, one liter plastic bottles, two liter plastic bottles, three liter plastic bottles, or a combination thereof), or any combination thereof floating on the water body's surface. The skimming device 100 and debris collector 101 are further configured to collect liquid debris such as floating petrochemicals, semi-solid debris, and/or other solid debris.

Figure 6:
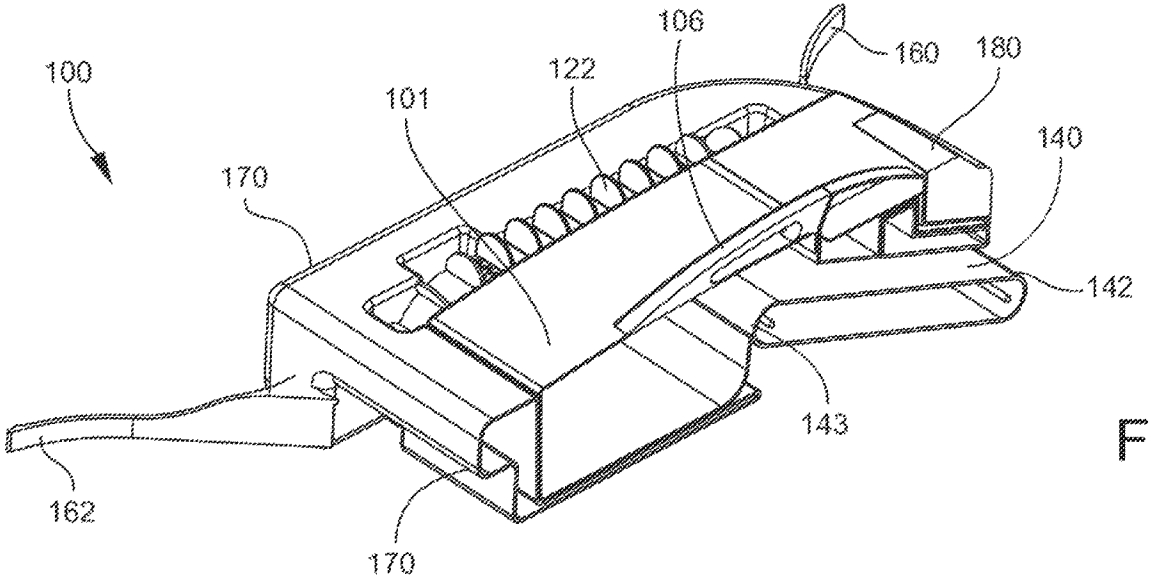
FIG. 6 is a cut away view of the skimming device.

As shown in FIGS. 1 and 6, the debris collector 101 may include a transparent panel 105 formed on an upper portion of the collector 101 for viewing collected debris inside the collector 101, and a handle 106 is also formed on an upper portion of the debris collector 101 spanning a length of the debris collector. In certain aspects, handle 106 allows a user to readily pick up and/or maneuver the fully assembled skimming device 100 and/or the debris collector 101 as desired. Handle 105 further allows a user to attach/engage the debris collector 101 with the housing 170 or readily detach/disengage the debris collector 101 from the assembled skimming device as desired to empty debris from the collector 101.

In certain aspects and when the skimming device is fully assembled, the debris collector 101 includes two side walls 107, 108 that are configured to be directly laterally adjacent to inner portions 177, 178 of the housing and endless belts 122, 123. It is envisioned that in certain aspects, the two side walls 107, 108 of the debris collector and the inner portions of 177, 178 of the housing may include a sliding engagement (e.g., tracks) or a snap fit engagement to secure the debris collector 101 to inner portions 177, 178 of the housing 170.

As alluded to above, the skimming device 100 also includes the skimming device movement member 120 that is configured to move the skimming device over the water surface as desired by the device user. The skimming device movement member 120 is positioned on opposite sides of the debris collector 101 and is carried on housing 170. The skimming device movement member 120 preferably includes two parallel spaced apart endless belts 122, 123 that are each configured to independently move the skimming device in the body of water. The two parallel spaced apart endless belts are positioned on opposite sides of the debris collector 101 and are preferably carried on/supported by inner portions 177, 178 of the housing.

Figure 5:
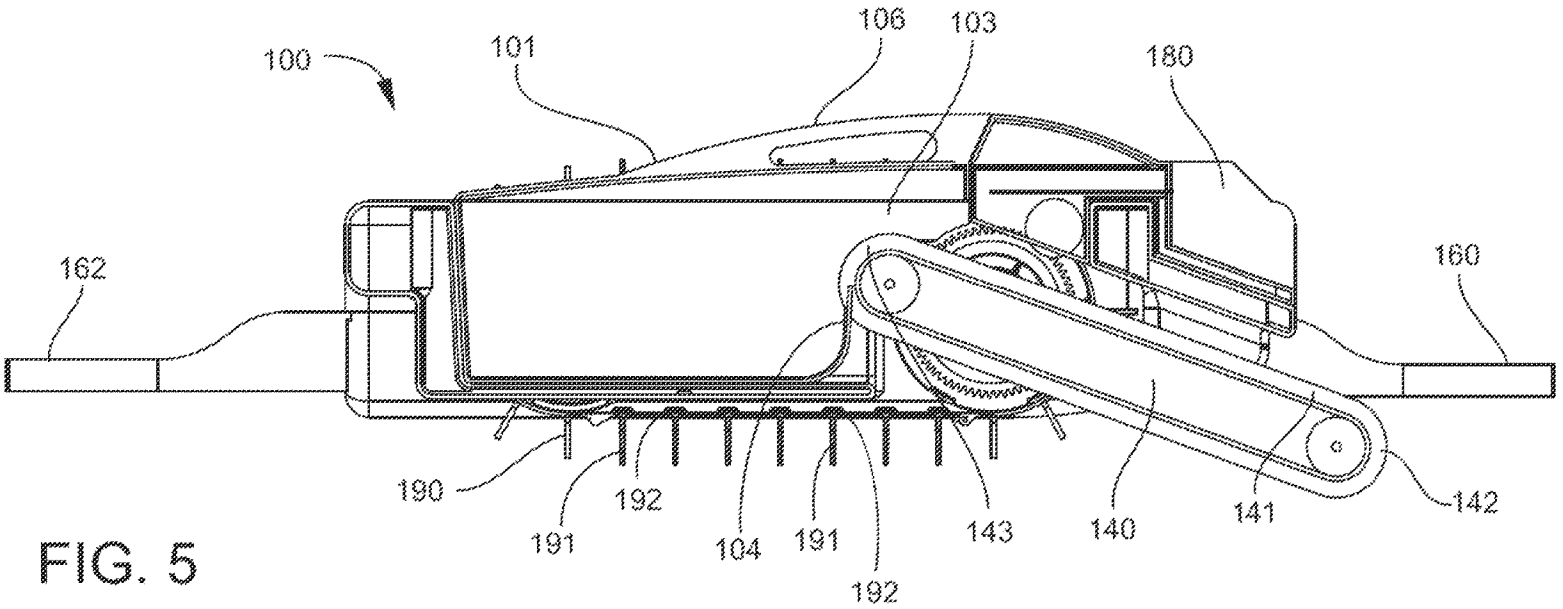
FIG. 5 is cross-section of the skimming device.

As shown in FIGS. 1, 2, 3, and 5, the skimming device 100 further includes a debris movement member 140 positioned between and extending away from each endless belt 122, 123. As shown in FIGS. 5 and 6, the debris movement member 140 is aligned with the opening 103 of the debris collector 101 and configured to capture the floating debris onto the debris collector. After capturing the debris, the captured debris is passed the into the debris collector 101 by concurrently moving the debris movement member 140 and the captured debris thereon in a direction towards the opening 103 of the debris collector 101. As shown, for example, in FIGS. 5-7 the debris collector 101 can include a conveyor belt 141 having a spaced apart first end 142 and second end 143. The first end 142 preferably extends into and/or below the water surface while the second end 143 is fixed in the housing 170 between the endless belts 122, 123. In certain aspects, the second end 143 of conveyor belt 141 is positioned in an inner diameter of each endless belt in a transverse axial plane relative to a longitudinal axis of each endless belt 122, 123 and does not contact the water surface. As further shown in FIGS. 3 and 5, the debris movement member 140 is preferably angled (e.g, an inclined angle) relative the two endless belts 122, 123 to further enhance debris capture by the skimming device. As further shown in FIG. 5, in certain aspects, second end 143 of conveyor belt 141 is directly laterally adjacent to arcuate front wall 104 having only sufficient clearance there between to allow for rotational movement of the conveyor belt but preventing debris from falling and/or becoming trapped there between. Because clearance is limited between second end 143 of conveyor belt 141 and arcuate front wall 104 captured debris falls directly within debris collector 101 as conveyor belt rotates.

Figure 2:
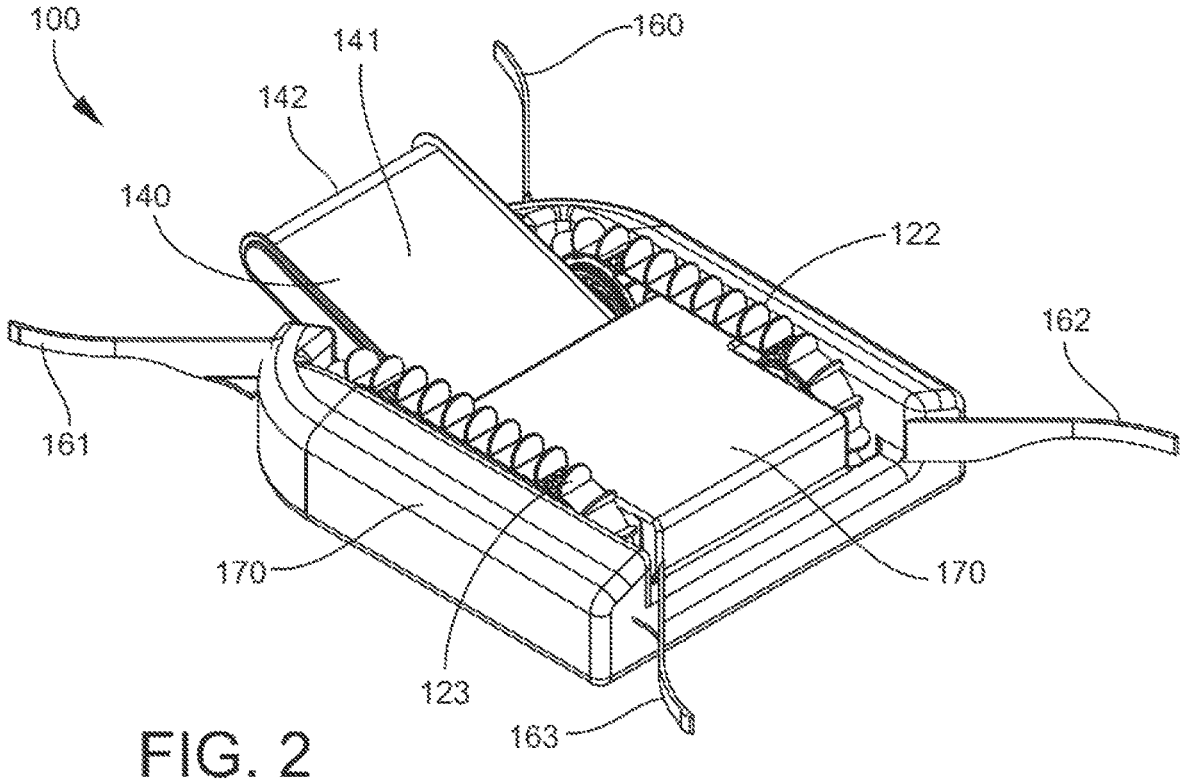
FIG. 2 is a bottom perspective view of the skimming device.

As further shown in FIGS. 1 and 2, the skimming device 100 may include a first set of deployable arms 160, 161 carried on the housing 170. The first set of deployable arms 160, 161 are positioned on opposite sides of the debris movement member 140 and act to direct/funnel floating debris towards the debris movement member 140 thereby maximizing debris collection of the skimming device 100. In certain aspects, the skimming device 100 may further includes a second set of deployable arms 162, 163 that are connected to the housing on a side opposite the first set of deployable arms. The second set of deployable arms 162, 163 preferably function as bumpers allowing the skimming device to effectively bounce off obstructions in the water and to effectively prevent and/or reduce the likelihood of the skimming device becoming undesirably fixed to objects in the water while in operation. Alternatively, one or more non-motorized wheel(s) (not shown) may be connected to the housing on a side of the housing opposite the first set of deployable arms. For example, two spaced apart wheels may be connected to the housing. The non-motorized wheel(s) rotate and/or turn freely thereby acting as bumpers when the non-motorized wheel(s) contacts an object to effectively bounce off obstructions in the water and to effectively prevent and/or reduce the likelihood of the skimming device becoming undesirably fixed to objects while in operation.

Figure 7:
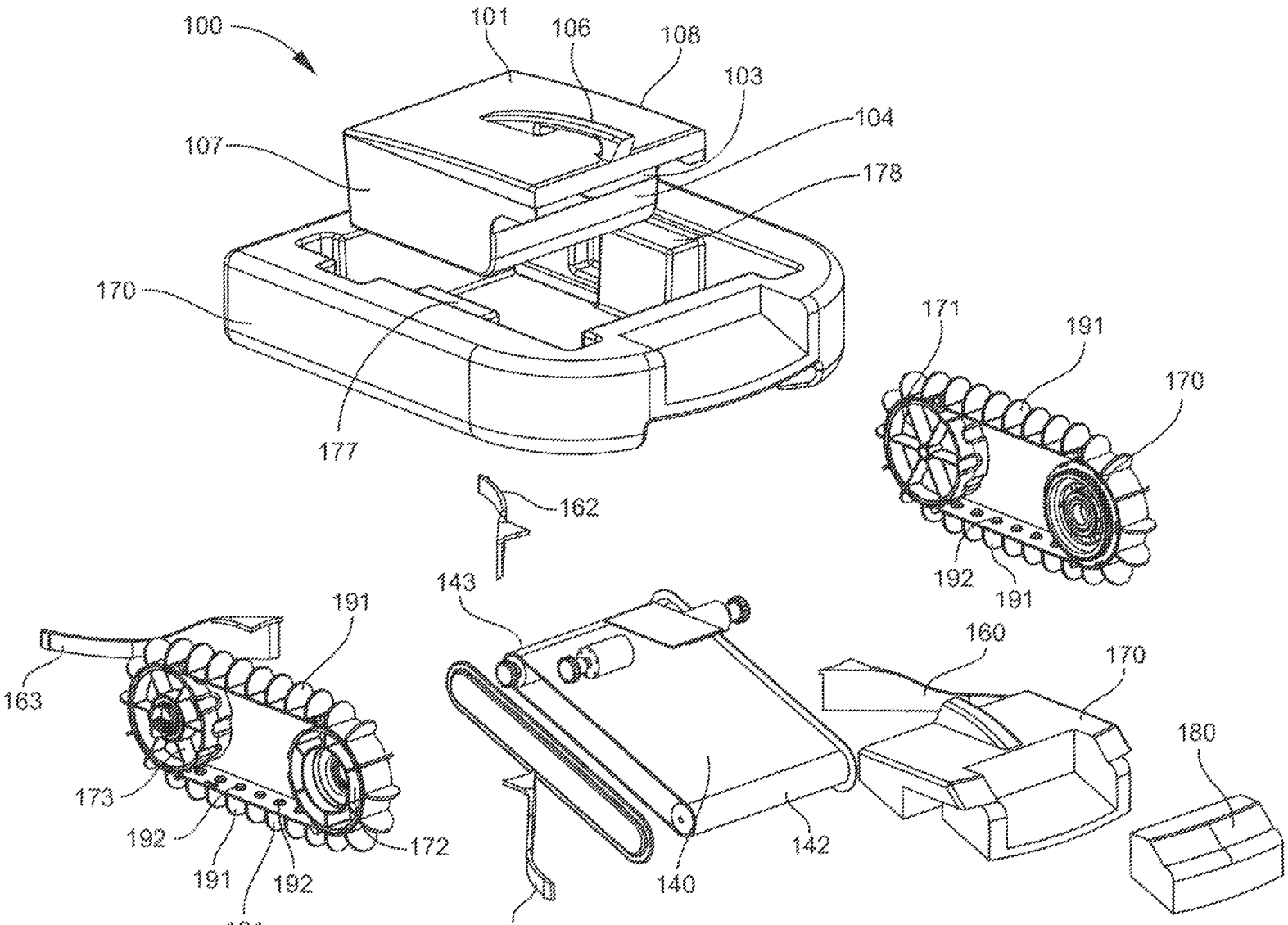
FIG. 7 is an exploded view of the skimming device.

With reference to FIGS. 1, 2, and 7, housing 170 is a rigid structure configured to carry endless belts 122, 123 and debris movement member 140 thereon. Housing 170 is further configured to securely receive debris collector 101 therein. As further shown in FIGS. 1, 2, and 7, housing 170 carries and/or houses power source 180 (e.g., a battery), electrical connections, and one or more motors that drive the endless belts 122, 123 and the debris movement member 140. As discussed further below, the power source 180 is electrically connected to each motor to operate/power the endless belts 122, 123 and the debris movement member 140. The housing 170 may further include a ballast on a side opposite the debris movement member 140 in order to provide improved overall stability for the skimming device 100, especially while the device is in operation.

Various motor and sprocket arrangements may be used to facilitate movement of the endless belts 122, 123 and debris movement member 140 in the skimming device 100. For example, a first motor (not shown) having a rotating shaft may be operatively linked to a power source (e.g., a battery 185) and the second end 143 of the conveyor belt 141. In certain aspects, power may be supplied from the power source to the motor thereby imparting rotational movement to the shaft enabling rotation of the conveyor belt thereby allowing floating debris to be captured on the conveyor belt and subsequently transported the debris collector 101. As further shown in FIG. 7, sprockets 170, 171, 172, 173 are respectively positioned in at least one endless belt 122, 123 and toothed portions of each sprocket engage an endless belt 122, 123. In certain aspects, sprockets 171 and 172 may independently be coupled to a second motor and third motor respectively by a rotating shaft. Similar to the first motor, the second motor and third motor may each be operatively linked to a power source configured to supply power from the power source (e.g., a battery) to the motor thereby actuating the motor and imparting rotational movement to the shaft enabling rotation of sprockets 170, 171, 172, 173 and each endless belt 122, 123. Alternatively, the skimming device 100 may include a single motor configured to independently drive each endless belt 122, 123 and the debris movement member 140.

Figure 3:
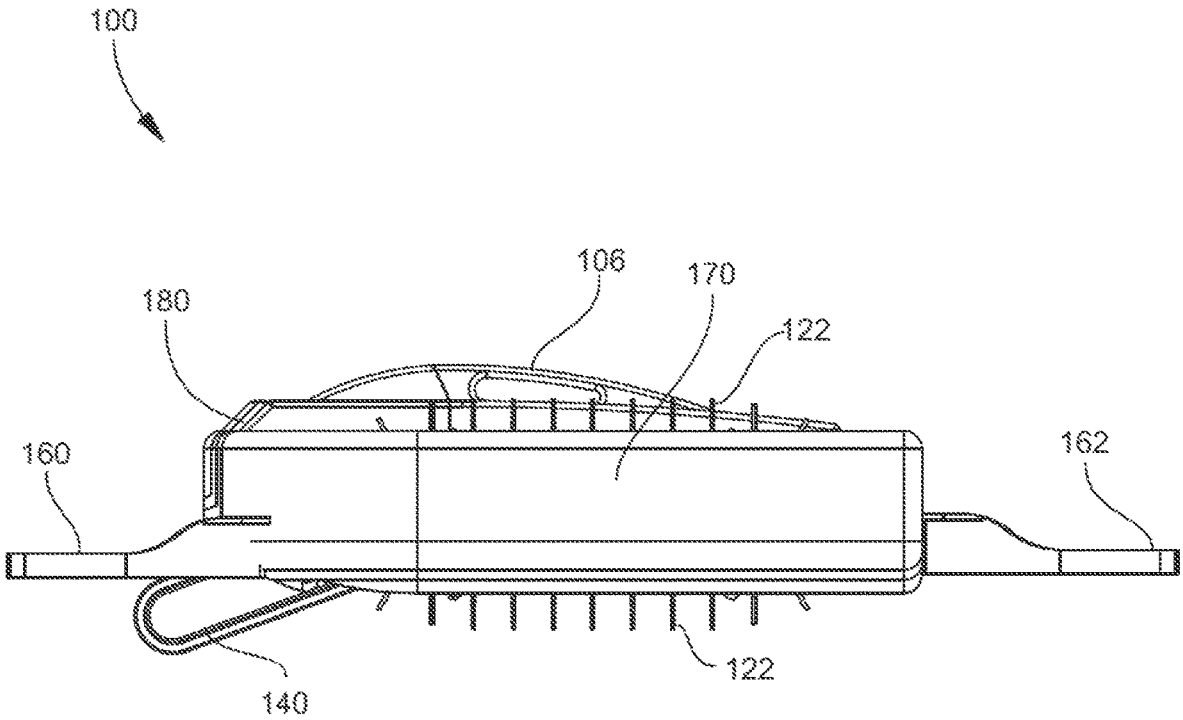
FIG. 3 is a side view of the skimming device.
Figure 4:
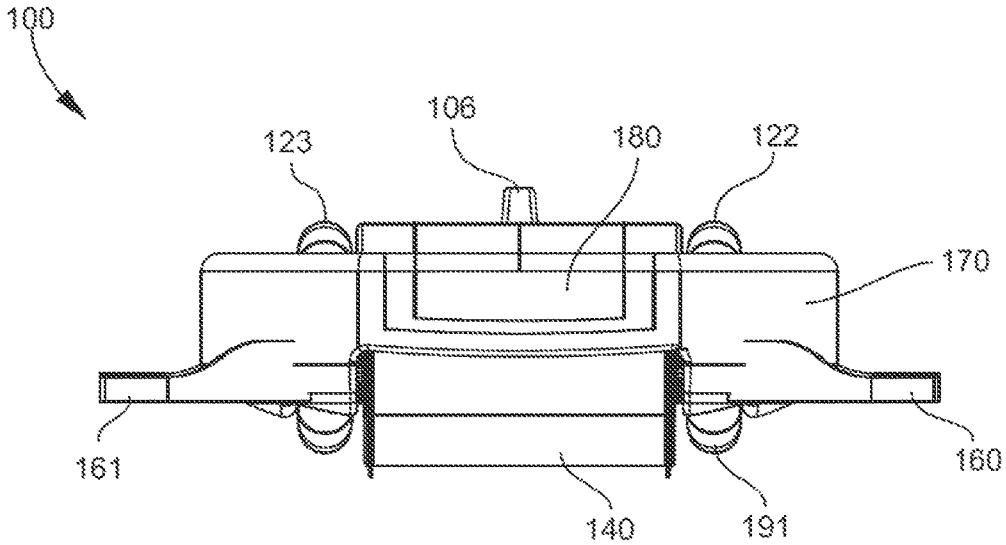
FIG. 4 is a front view of the skimming device.

In certain additional aspects, each endless belt 122, 123 includes flat surface having an upper portion and lower portion. The endless belt's lower portion of the flat surface is directly adjacent to inner portions 177, 178 of housing 170 and toothed portions of sprockets 170, 171, 172, 173. The endless belt further includes fins 190 extending in a substantially perpendicular direction relative to the flat surface of the endless belt having both above an upper portion 191 extending above the flat surface of the belt and a lower portion 192 extending below the flat surface of the endless belt. Portions of the fins extending below flat surface 192 of the endless belt engage the recessed portions between the sprocket teeth. This fin 190 and sprocket engagement is concealed by the housing 170. Portions of the fins extending above the endless belt's flat surface preferably have an arc shape and sufficient length propel the skimming device through the water when the sprockets 170, 171, 172, 173 are rotated, as discussed above. As shown in FIGS. 3 and 5, in certain preferred embodiments, only the first end 142 of the conveyor belt 141 (portions of the debris movement member) and portions of the two endless belts extending below the housing 170 are configured to extend into the body of water while the remaining portions of the skimming device are above and/or flush with the water surface.

In certain aspects, the debris movement member 140 and endless belts 122, 123 may be moved simultaneously, in concert thereby moving the skimming device 100 while collecting debris. In other aspects, the debris movement member 140 and endless belts 122, 123 may be moved independently relative to one another, thereby allowing the skimming device 100 to maneuver throughout the body of water as desired (e.g., turning, stopping, etc.) and allowing the debris movement member 140 to move/collect debris independently of endless belt 122, 123 movement.

In certain aspects, the skimming device 101 may be configured for remote control using a desired transmitter within a remote control and a receiver (not shown) included in the skimming device 101. For example, radio remote control (RF remote control) or Infrared remote control may be used to control the skimming device from a remote location. In certain aspects, the skimming device may be operably connected to and guided by a global positioning system (GPS) or other remote methods. The remote control can preferably move the debris movement member 140 and endless belts 122, 123 in any of the above described manners. Likewise, the skimming device may be further configured with internet connectivity (e.g., WiFi) and further configured to communicate with a user's peripheral device (e.g., a smartphone) to implement desired software applications as desired by the user. In certain aspects, the skimming device may also be configured for data collection via onboard sensors housed within the device configured for communication with a user's peripheral device.

In certain aspects, portions of the pool skimming device 100 may be made of blow molded or injection molded thermoplastic resins, including but not limited to, polyethylene, polypropylene, polyvinyl chloride, polyacrylates (e.g., poly (methyl methacrylate)), or any combination thereof. The pooling skimming device 100 may also be made of a metal material.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

What is claimed is:

1. A skimming device configured to collect debris from a body of water comprising:

(a) a debris collector for receiving and storing captured debris therein;

(b) a skimming device movement member positioned on opposite sides of the debris collector, the skimming device movement member comprising spaced apart endless belts configured to move the skimming device in the body of water;

(c) a debris movement member positioned between each endless belt that is aligned with an opening of the debris collector and is configured to capture floating debris from the body of water and pass the captured debris into the debris collector, and (d) a housing that surrounds the debris collector such that the endless belts of the skimming movement member extend above and below the housing.

2. The skimming device of claim 1, wherein the debris movement member comprises a conveyor belt having a first end positioned between each endless belt and a second end that extends away from and is outside of the housing.

3. The skimming device of claim 1, wherein a recess is formed on the housing and is aligned with the opening of the debris collector to pass captured debris from the debris movement member into the debris collector.

4. The skimming device of claim 1, wherein the debris movement member is angled relative to the endless belts and is configured to extend into the body of water when in use.

5. The skimming device of claim 1, wherein the debris collector is removably attached to the skimming device.

6. The skimming device of claim 1, further comprising a first set of deployable arms attached to the housing that are configured to direct floating debris towards the conveyor belt.

7. The skimming device of claim 6, further comprising a second set of deployable arms attached to the housing on a side opposite the first set of deployable arms.

8. The skimming device of claim 7, wherein portions of the debris collector, the endless belts, the first set of deployable arms, and the second set of deployable arms are coplanar, and the second end of the conveyor belt is not coplanar with the two endless belts and debris collector.

9. The skimming device of claim 1, wherein the skimming device is battery operated, configured for remote control, or a combination thereof.

10. The skimming device of claim 9, wherein the skimming device is configured for Wi-Fi connectivity, remote control from a peripheral device, or a combination thereof.

11. The skimming device of claim 1, wherein the skimming device is configured for Wi-Fi connectivity, remote control from a peripheral device, or a combination thereof.

12. The skimming device of claim 1, wherein the debris collector and housing each comprise a molded thermoplastic resin, metal, or a combination thereof.

* * * * *